US006041531A

United States Patent [19]

Lunde

[11] Patent Number: 6,041,531

[45] Date of Patent: Mar. 28, 2000

[54] BLACKLIGHT SPECIAL EFFECT FIXTURE

[75] Inventor: Montgomery C. Lunde, Canyon Country, Calif.

[73] Assignee: Technifex, Inc., Valencia, Calif.

[21] Appl. No.: 08/970,657

[22] Filed: Nov. 14, 1997

[51] Int. Cl.[7] ..... G09F 13/00

[52] U.S. Cl. ..... 40/431; 40/560; 40/506

[58] Field of Search ..... 40/466, 473, 493, 40/506, 507, 560; 362/277, 280, 282, 284, 319, 322, 327

[56] References Cited

U.S. PATENT DOCUMENTS

| | | | |
|---|---|---|---|
| 1,009,839 | 11/1911 | Hata | 40/433 |
| 1,900,187 | 3/1933 | Matter | 40/506 |
| 2,371,172 | 3/1945 | Hotchner | 40/560 |
| 3,348,043 | 10/1967 | Mehus | 40/473 |
| 3,736,742 | 6/1973 | Mabuchi et al. | 368/10 |
| 3,791,058 | 2/1974 | Mollica | 40/431 |
| 3,800,451 | 4/1974 | Bulkley | 40/433 |
| 4,002,534 | 1/1977 | Swartz | 40/431 |
| 4,364,106 | 12/1982 | Lam | 362/272 |
| 4,779,176 | 10/1988 | Bornhorst | 40/560 |
| 5,033,965 | 7/1991 | Chiu et al. | 434/131 |
| 5,205,636 | 4/1993 | Carpenter | 362/84 |
| 5,311,226 | 5/1994 | Karasawa | 353/30 |
| 5,416,674 | 5/1995 | Murai | 362/84 |
| 5,455,755 | 10/1995 | Bandy | 362/284 |
| 5,685,097 | 11/1997 | Marinov | 40/431 |

*Primary Examiner*—Anthony Knight
*Assistant Examiner*—Mark Williams
*Attorney, Agent, or Firm*—Holme Roberts & Owen LLP

[57] ABSTRACT

The present invention provides a blacklight or ultraviolet light special effect fixture for use in emulating a shimmering or water ripple type of pattern. In one embodiment, the fixture includes a drum, a motor for rotating the drum and a frame for positioning the drum between a blacklight source and a uv treated projection surface.

33 Claims, 7 Drawing Sheets

BLACKLIGHT SPECIAL EFFECT FIXTURE

FIELD OF THE INVENTION

The present invention relates to a blacklight special effect and, in particular, to an apparatus that is used in conjunction with a blacklight to create a special lighting effect on a projection surface that has been treated such that it converts the ultraviolet ("uv") light produced by the blacklight into visible light.

BACKGROUND OF THE INVENTION

Special effect lighting can be generally categorized according to the type of light used to achieve the effect. One type of light that is used to produce special effects is "white light", which is the spectrum of light that is visible to humans and seen, for example, in a rainbow. One type of white light special effect involves the placement of two overlapping disks between a white light source and a projection surface to achieve various effects. The disks have holes or windows that permit light to pass through. Upon rotation of the disks, the windows associated with one of the disks occasionally line up with windows associated with the other disk so that light from the white light source passes through the disks and onto the projection surface. By appropriately selecting the positions of the windows, various special effects can be achieved. For example, a random pattern of windows can be used to achieve a "snowfall" effect.

Separate from white light special effects are "blacklight" special effects that use ultraviolet light, which is outside the spectrum of light that is generally visible to humans, to produce the special effect. Because ultraviolet light or blacklight cannot be seen, these special effects also involve a projection surface that has been treated with a blacklight paint or similar substance that when irradiated with ultraviolet light, produces visible light. However, the visible light that is produced is relatively faint. The faint light produced in blacklight special effects provides the "eerie" glow that makes blacklight special effects especially appropriate in, for example, the haunted house rides in amusement and theme parks. However, due to the faintness of the light produced in a blacklight special effects, the effect can be easily ruined or washed out by white light. Consequently, the implementation of a blacklight special effect generally requires greater attention to the design of the environment in which the effect is to occur than does the typical white light special effect. One type of blacklight special effect involves the placement of a rotating disk between the blacklight source and the projection surface. The disk has one or more windows that permit the blacklight to pass through and onto the projection surface. Rotation of the disk creates a flickering or strobing effect, i.e. the ultraviolet light is permitted to pass by the windows to pass onto the projection surface and then prevented from passing onto the projection surface by opaque areas that are located between the windows on the disk.

SUMMARY OF THE INVENTION

The present invention provides a fixture for use in conjunction with a blacklight and an appropriately treated projection surface to produce a "water ripple" or "shimmering" type of special effect similar to the image produced upon a wall that is located adjacent to a rippling pool of water when light is shined upon the pool of water. Such an image is complex. To elaborate, the image of the ripple produced on the wall has varying intensities, i.e. the portion of the image associated with the crest of a ripple is more prominent than the portion of the image associated with the trough of the ripple. However, the intensity of the image corresponding to the trough of the ripple is typically not characterized by the absence of light, i.e. this portion of the image is not black. Instead, the trough portion of the image is typically fainter than the portion of the image associated with the crest. The image of the ripple produced on the wall also moves across the wall as the ripple moves across the pool. Further, the shape of the ripple typically changes over time as the ripple interacts with, for example, other ripples. The invention includes a mask structure that facilitates the production of blacklight image on a projection surface that emulates the noted "water ripple" image, a motor for moving the mask and a frame for positioning the mask between the blacklight source and the projection surface. In one embodiment, the mask structure employs a drum with an axis of rotation that is substantially perpendicular to the direction in which the blacklight is being projected. The drum has a series of cutouts that modulate the blacklight and, in so doing, facilitate the production of an image on the projection surface that has the noted variation in intensities. By rotating the drum, the movement and change in shape needed to emulate a water ripple is achieved.

The present invention also provides a fixture for producing a blacklight special effect in which a mask moves in a linear fashion that facilitates the production of blacklight special effects. In one embodiment, the fixture includes a mask, a frame for positioning the mask in front of the blacklight source, and a motor for moving the mask such that the projection of a point on the mask onto a plane that is perpendicular to the direction in which the blacklight is being projected follows a substantially linear path. In one embodiment, the mask includes a closed and substantially rigid surface, such as a hollow drum, that rotates about an axis which is substantially perpendicular to the direction in which the blacklight is being projected. Windows are cut in the surface of the drum so that upon rotation of the drum at least portions of two of the windows line up with one another to let blacklight pass through the drum and onto the projection surface. In another embodiment, the mask includes a flexible web, i.e. a flexible material such as paper, cloth, sheet metal or plastic, that is formed into a belt or closed-surface which defines an enclosed space. Two rollers positioned within the web cooperate to move the web in the required linear fashion. A further embodiment employs a mask with two separate screens that are moved in the required linear fashion. With two separate screens, independent control over the direction in which the two screens are moved and the speed at which the two screens are moved is possible, thereby facilitating further control over the type of special effect. In yet another embodiment, the mask includes a panel and a motor for moving the panel in the noted linear fashion.

The present invention also provides a fixture in which ultraviolet light passes through two portions of a mask to achieve a blacklight special effect. The fixture employs a mask that requires the blacklight produced by the blacklight source to pass through both a first portion of the mask and a second portion of the mask to reach the projection surface. Moreover, both the first and second portions of the mask move. In one embodiment, certain special effects are achieved by controlling the direction in which the two portions of the mask move. For instance, the portions of the mask can be moved in the same direction, opposite directions or at an angle to one another. Further effects can be achieved by moving the portions at the same or different speeds.

The present invention also provides a fixture for use in producing blacklight special effect that is capable of producing an image on the projection surface that moves in a linear fashion. The fixture includes a mask and a motor to move the mask so as to achieve the linear movement of the image. In one embodiment, the mask is a drum with an axis of rotation that is substantially perpendicular to the direction in which the blacklight is being projected. The drum has a pair of windows that have a helix characteristic. As the drum rotates, the points on diametrically opposite sides of the helix that line up with one another to let blacklight pass onto the projection surface move along the length of the drum as the drum rotates, thereby producing an image on the projection surface with linear movement.

DETAILED DESCRIPTION

Figure 1:
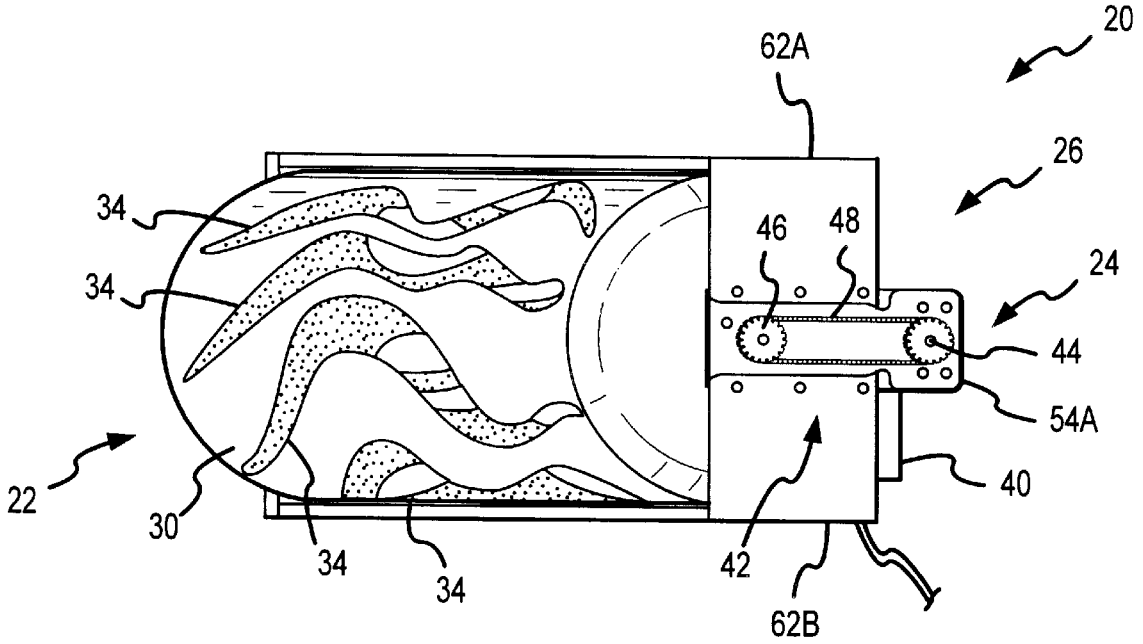
FIG. 1 is a perspective view of an embodiment of the blacklight fixture of the present invention.
Figure 2:
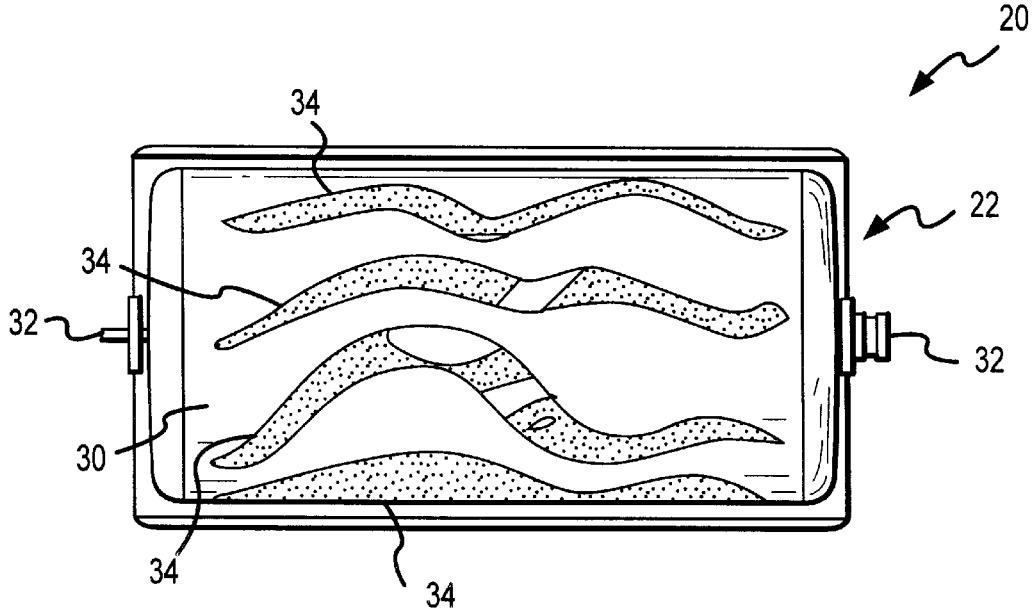
FIG. 2 is a front view of the blacklight fixture shown in FIG. 1.
Figure 3:
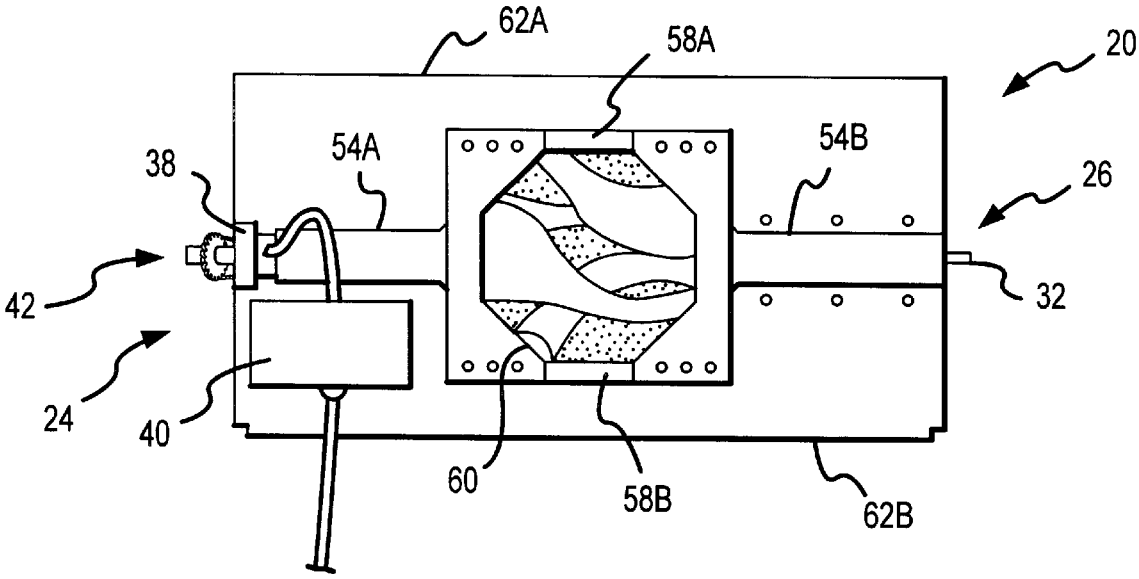
FIG. 3 is a rear side view of the blacklight fixture shown in FIG. 1.
Figure 4:
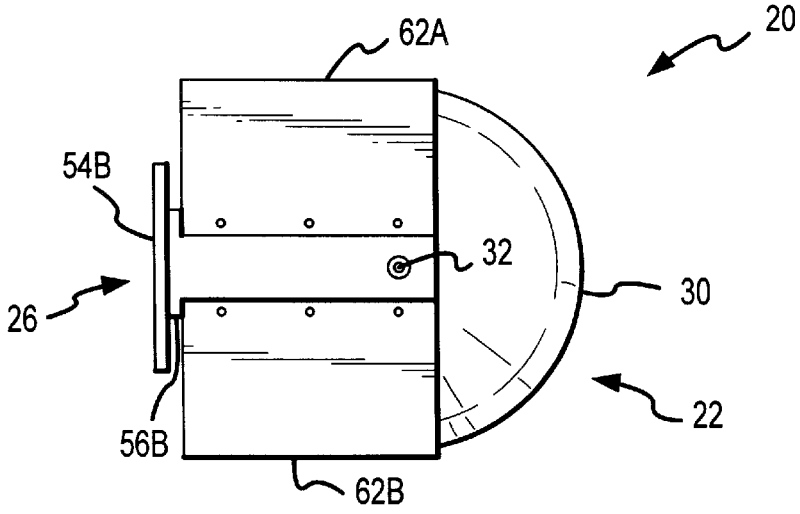
FIG. 4 is a right side view of the blacklight fixture shown in FIG. 1 with the motor and transformer removed.

With reference to FIGS. 1–4, an embodiment of the blacklight special effect fixture 20, hereinafter referred to as fixture 20, of the present invention is described. The particular embodiment of the fixture 20 illustrated in the noted figures is particularly adapted, in conjunction with a blacklight source, to produce an image on a projection surface that emulates a "water ripple" or "shimmering" image. The "water ripple" image refers to the image produced on a wall that is located adjacent to a rippling pool of water when a light is shone upon the water. Characteristic of such an image that the portion of the image representative of the crest of a ripple is more intense than the portion of the image representative of the trough of the ripple. Also characteristic of the "water ripple" image is that the image moves over time and the shape of the ripple changes over time. While the fixture 20 is capable of producing an image that emulates a "water ripple", it should be appreciated that there are a number of other images that can also be characterized as having varying intensity, movement over time and/or change in shape over time. These other images are also susceptible to emulation by the fixture 20 by making the appropriate modifications.

Generally, the fixture 20 includes a mask 22 for blocking/transmitting the ultraviolet light produced by a blacklight source to produce the desired "water ripple" image on the projection surface with the required variation in intensities, a motor mechanism 24 for moving at least a portion of the mask 20 to produce the movement and change in shape needed for the effect, and a frame 26 for positioning the mask 22 between the blacklight source and the projection surface.

The mask 22 includes a closed-end, hollow drum 30 that is operatively attached to the frame 26 for rotation about an axle 32 that is located substantially perpendicular to the direction in which the blacklight is being projected. The drum 30 has a number of windows 34 that are used in achieving the varying intensity characteristic of the "water ripple" effect. The shapes of the windows 34 can be modified to achieve different types of special effects. The drum is made from a relatively rigid material, such as sheet metal or plastic. If desired, one or more elements can be placed within the drum 30 to facilitate the production of a blacklight special effect. For instance, one or more transparent tubes that carry prismatic or diffraction optical elements can be nested within the interior of the drum 30.

The motor mechanism 24 is used to rotate the drum and thereby produce the needed movement and change in shape needed to produce the "water ripple" effect. The motor mechanism 24 includes a dc motor 38, a transformer 40 for providing dc power to the motor 38, and a chain drive mechanism 42 for transferring rotational power from the motor 38 to the closed-end drum 30. The chain drive mechanism 42 include a first cog 44 that is associated with the motor 38, a second cog 46 that is in registration with the axle 34 of the drum 30, and a chain 48 that connects the first cog 44 and the second cog 46.

Figure 5:
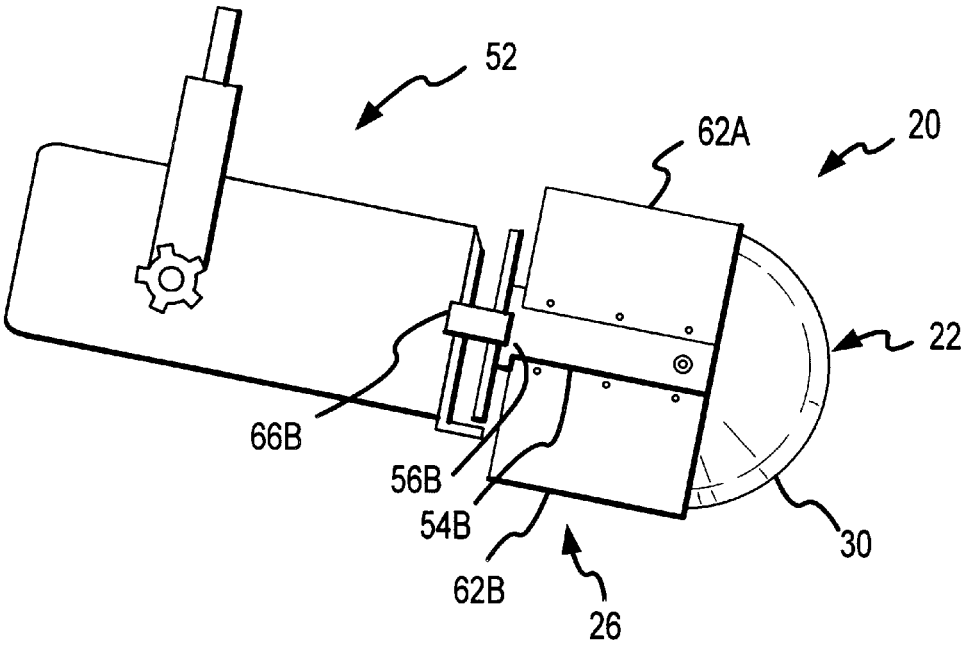
FIG. 5 is a side view of the blacklight fixture shown in FIG. 1 mounted on an arc light or other light source that can be used to produce ultraviolet light.
Figure 6:
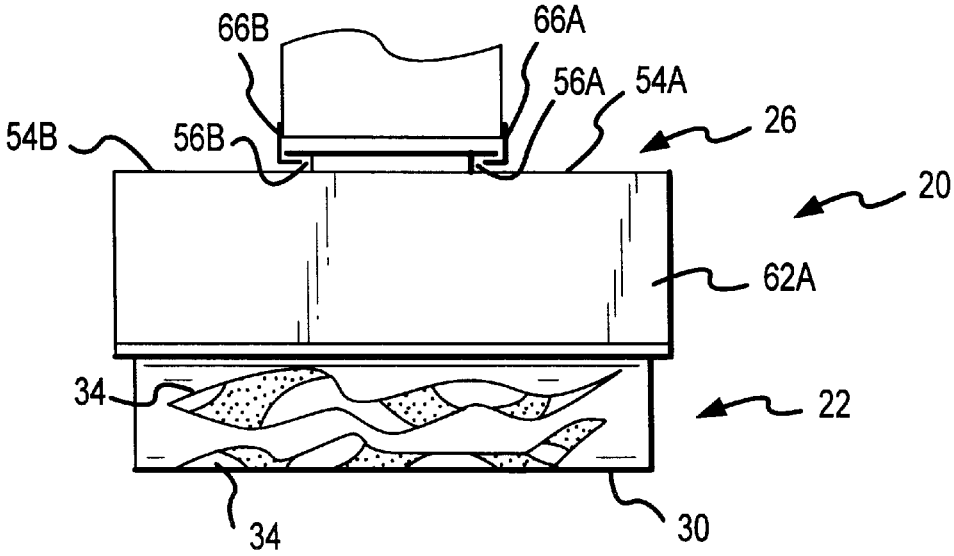
FIG. 6 is a top view of the blacklight fixture shown in FIG. 1 mounted on an arc light or other light source that can be used to produce ultraviolet light.

The frame 26 in the illustrated embodiment, in addition to positioning the mask 22 between the blacklight source and the projection surface, serves a number of other purposes. With reference to FIGS. 5 and 6, the frame 26 also serves to connect the fixture 20 to a blacklight source 52. In the illustrated embodiment, the blacklight source 52 is an arc light that produces a broad spectrum of light. As a consequence, associated with the arc light is a filter that permits substantially only ultraviolet light to be transmitted. The frame 26 also directs substantially all of the ultraviolet light output by the blacklight source 52 through the mask 22. This is accomplished, at least in part, by connecting the frame 26 very close to the point at which the ultraviolet light leaves the blacklight source 52.

The frame 26 includes first and second lateral members 54A, 54B that are generally L-shaped. The first and second lateral members 54A, 54B also define first and second slots 56A, 56B, which are used to connect the frame 26 to the blacklight source 52. The first and second lateral members 54A, 54B are connected to one another via first and second cross members 58A, 58B. The structure defined by the first and second lateral members 54A, 54B and the first and second cross members 58A, 58B also defines an opening 60 through which the ultraviolet light produced by the blacklight source 53 enters the fixture 20. Connected to the first and second lateral members 54A, 54B are first and second shroud members 62A, 62B that primarily serve to constrain the ultraviolet light produced by the blacklight source 52 so that the ultraviolet light passes through the mask 22 and onto the projection surface. The dc motor 38, transformer 40 and chain drive mechanism 42 are all operatively attached to a portion of the frame 26.

With reference to FIGS. 5 and 6, the fixture 20 is used by initially mounting the fixture 20 to the blacklight source 52. The blacklight source 52 includes first and second L-shaped arms 66A, 66B that extend forward from the lateral sides of the blacklight housing and a stop 68 that extends forward from the bottom of the blacklight housing. The fixture 20 is mounted to the blacklight source 52 by sliding the first and second slots 56A, 56B of the frame 26 over L-shaped members 66A, 66B until prevented from going further by the stop 68.

It should also be noted that the diameter of the drum 30 is greater than the vertical dimension of the surface of the blacklight source 52 through which the ultraviolet light is projected, which is roughly equal to the vertical dimension of the opening 60 of the frame 26. This assures that the image produced on the projection surface is not "framed" by straights lines at the bottom and top of the image, which is the effect that would occur if the diameter of the drum 30 was equal or less than the vertical dimension of the noted surface of the blacklight source 52.

Figure 7:
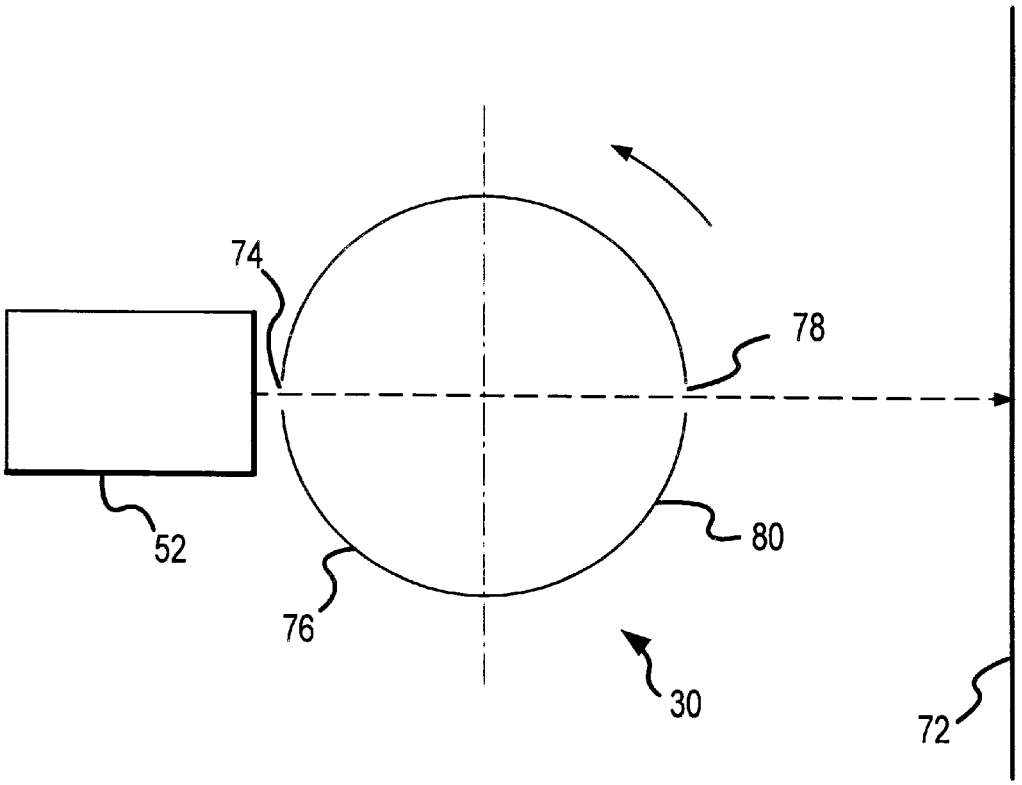
FIG. 7 illustrates the passage of ultraviolet light through two surfaces of the mask associated with the fixture shown in FIG. 1.

Once the fixture 20 is connected to the blacklight source 52, the "water ripple" can be established on a projection surface to by activating the blacklight source 52 and the chain drive mechanism 42 to rotate the drum 30. With reference to FIG. 7, it should be appreciated that the ultraviolet light produced by the blacklight source 52 that reaches the projection surface 72 must pass through windows associated with two surfaces. More specifically, the ultraviolet light must pass through a first window 74 associated with a first side 76 of the drum 30, which is located nearest to the blacklight source 52, and a second window 78 associated with a second side 80 of the drum 30, which is located further away from the blacklight source 52 than the first side 76 of the drum 30. In addition, the windows through which the ultraviolet light passes to reach the projection surface 72 are moving. In the illustrated embodiment, the first window 74 is moving downward, i.e. from the top of the drawing towards the bottom of the drawing. In contrast, the second window is moving in the opposite direction, i.e. upward. It should also be appreciated that, while the first and second windows 74, 78 are moving in opposite directions, they are moving at the same speed. In the case of the drum 30, the first and second windows 74 and 78 are moving at the same rotational speed.

Figure 8A:
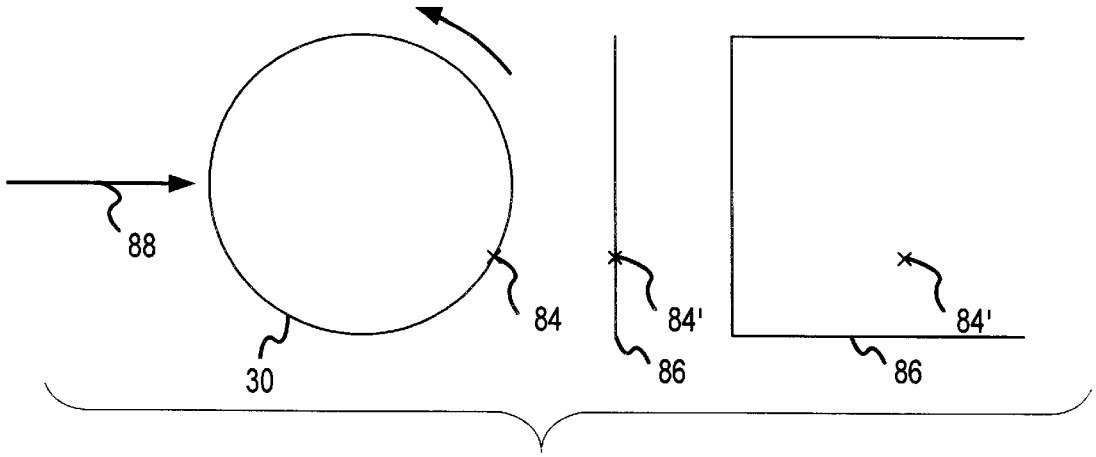
FIG. 8A–8C illustrates how a point on the mask of the blacklight fixture shown in FIG. 1 when projected onto a plane that is substantially perpendicular to the direction in which the blacklight is being projected, follows a substantially linear path.
Figure 8B:
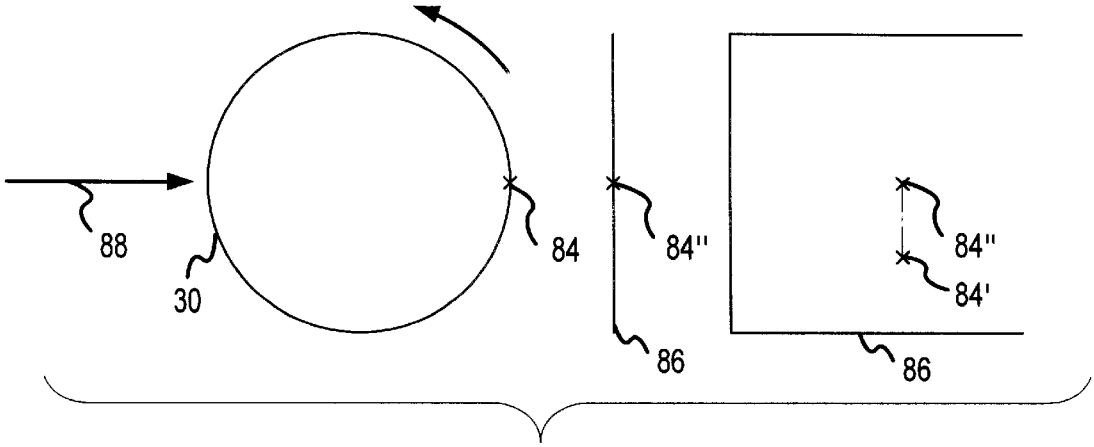
Figure 8C:
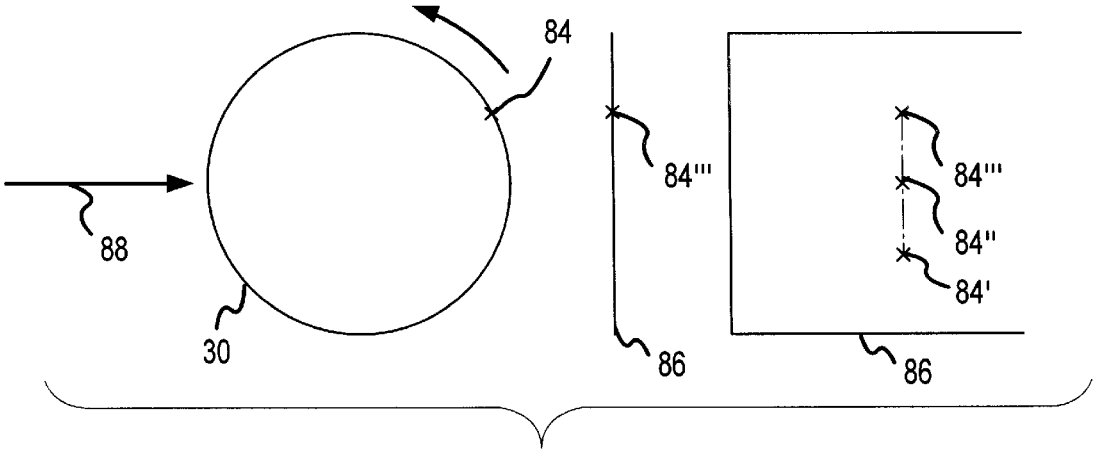

With reference to FIGS. 8A–8C, it should also be appreciated that the mask 22 crosses the ultraviolet light output by the blacklight source in a linear fashion, which makes certain special effects easier to achieve relative to devices that use a rotating disk. This linear aspect can be appreciated by noting that a point 84 on the drum 30 when projected onto a plane 86 (which is shown in both side and plane views) that is substantially perpendicular to the direction 88 in which the ultraviolet light is being projected, follows a linear path (defined by points 84', 84" and 84'") as the drum 30 rotates. In contrast, a point on a disk that rotates about an axis that is substantially parallel to the direction in which ultraviolet light is being projected follows an arc.

Figure 9:
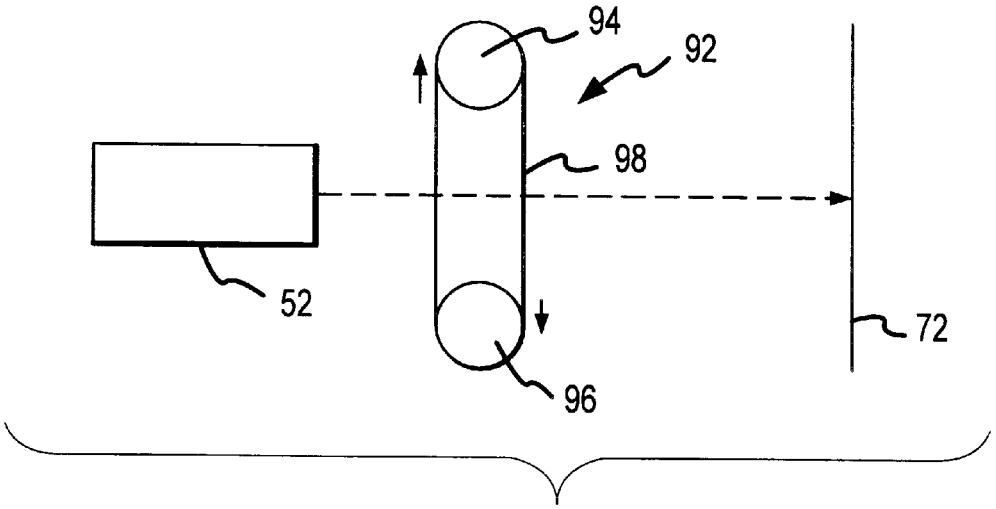
FIG. 9 illustrates an alternative mask structure that employs a closed-surface, flexible web.

With reference to FIG. 9, a second mask structure 92 is illustrated that, like the drum 30, has two surfaces through which the ultraviolet light must pass to reach the projection surface. Also, like the drum 30, the surfaces are moving in opposite directions and at the same speed. Further, the second mask structure also possesses the noted linear characteristic, i.e. the projection of a point on the surface when projected on a plane that is substantially perpendicular to the direction in which the ultraviolet light is being projected, follows a linear path. The second mask structure 92 includes a first roller 94, a second roller 96 and flexible web 98 that is formed into a closed surface. The flexible web 98 has windows for achieving the desired blacklight special effect. A motor (not shown) is used to rotate the first roller 94 and thereby move the flexible web 96. The flexible web 98 can be made from a number of materials, including paper, cloth, sheet metal, mylar and plastic.

Figure 10:
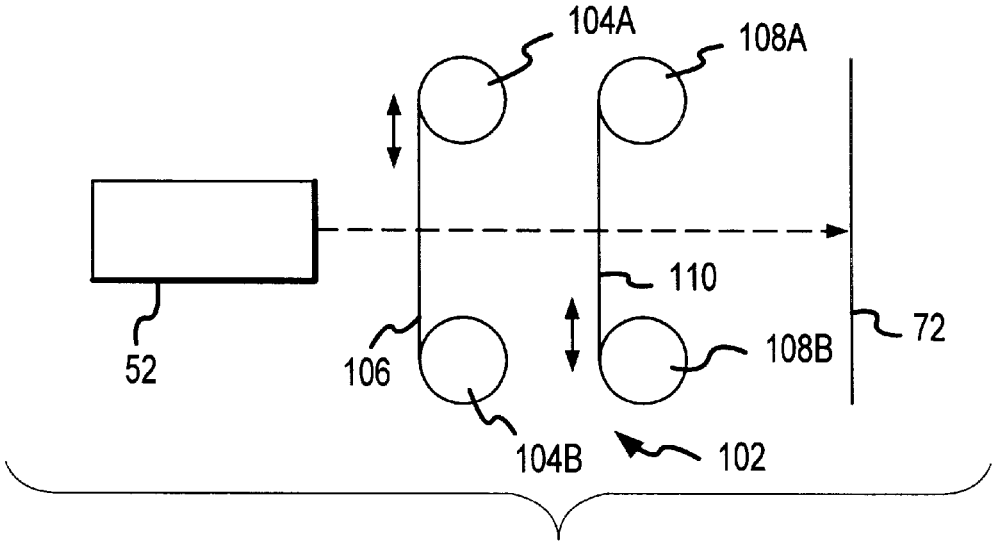
FIG. 10 illustrates another alternative mask structure that employs two separate flexible webs.

FIG. 10 illustrates a third mask structure 102 that provides two surfaces through which the ultraviolet light must pass to reach the projection surface. However, unlike the drum 30, the third mask structure 102 provides for independent control of the direction which the two surfaces move and the speed at which the two surfaces move. To elaborate, the movement of the two surfaces can be independently controlled so that the surfaces move in the same direction or in opposite directions. Further, the speed at which the two surfaces are moving can be controlled to be either the same speed or different speeds. The third mask structure 102 does, however, have the noted linear characteristic. The third mask structure 102 includes a first pair of rollers 104A, 104B and a first flexible web 106 with the appropriate windows for achieving the desired blacklight special effect. A motor mechanism (not shown) drives the first pair of rollers 104A, 104B such that first flexible web 106 is unwound from one of the first pair of rollers onto the other of the first pair of rollers, like a cassette tape drive. A second pair of rollers 108A, 108B and second flexible web 110 function in substantially the same manner as the first pair of rollers and first web.

Figure 11:
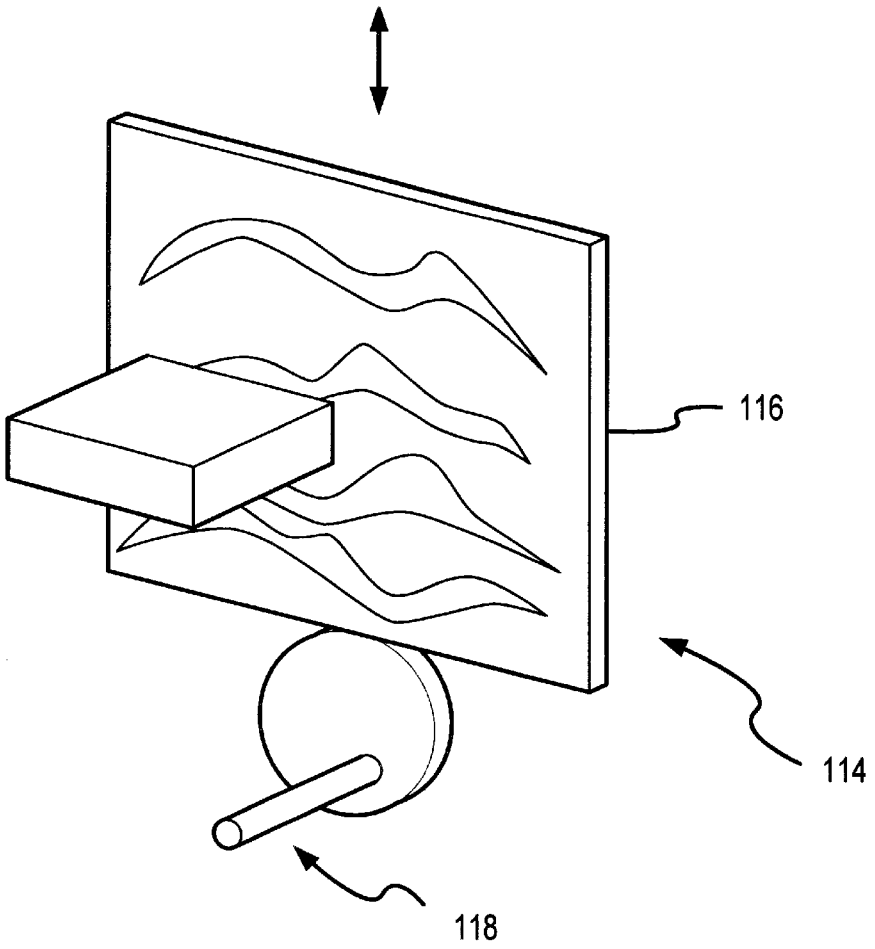
FIG. 11 illustrates yet another alternative mask structure that employs panel which is moved in a linear fashion.

With reference to FIG. 11, a fourth mask structure 114 that provides the noted linear movement is described. The fourth mask structure 114 is comprised of a panel 116 that is articulated in a linear fashion relative to the direction in which ultraviolet light is being projected. In the illustrated embodiment, movement of the panel 116 is achieved by the use of a cam shaft 118 that is driven by a motor (not shown). The cam shaft 118 can be extended to drive other panels. By appropriate placement of the cam elements, the panels can be driven in the same or different direction. Other drive mechanisms are feasible. For example, it is also possible to provide independent control of the direction and speed at which each such panel is articulated, as discussed with respect to the third mask structure 102.

Figure 12:
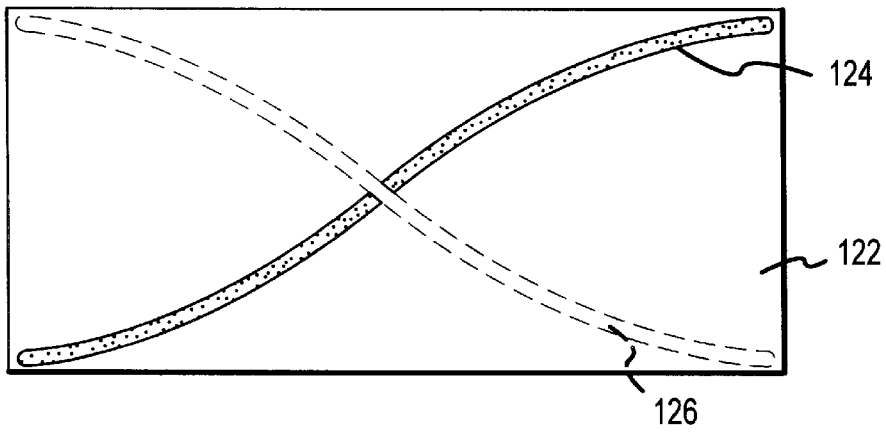
FIG. 12 illustrates a mask structure for creating a blacklight special effect in which the image moves in a linear fashion.

With reference to FIG. 12, a drum 122 that is suitable for use in the fixture 20 and adapted to produce a blacklight image that moves in a linear fashion on the projection surface is discussed. The drum 122 includes a first window 124 and a second window 126 that form a helix pattern. Upon rotation of the drum 122, the points associated with the windows 124, 125 that are on diametrically opposite sides of the drum 122 and that line up with one another to let ultraviolet light pass onto the projection surface move linearly along the length of the drum 122, thereby achieving an image that moves linearly on the projection surface. Provided that the helix relationship between the first and second windows 124, 126 is maintained, the shape of the windows 124, 126 can be modified to change the shape of the image that is moving linearly across the projection surface.

The foregoing description of the invention has been presented for purposes of illustration and description. Further, the description is not intended to limit the invention to the form disclosed herein. Consequently, variations and modifications commensurate with the above teachings, and the skill or knowledge in the relevant art are within the scope of the present invention. The preferred embodiment described hereinabove is further intended to explain the best mode known of practicing the invention and to enable others skilled in the art to utilize the invention in various embodiments and with the various modifications required by their particular applications or uses of the invention. It is intended that the appended claims be construed to include alternate embodiments to the extent permitted by the prior art.

What is claimed is:

1. A blacklight special effect system comprising:

a blacklight source for producing a beam of ultraviolet light:

a blacklight fixture comprising:

a drum for interacting, during operation, with the beam of ultraviolet light produced by the blacklight source to produce a modified beam of ultraviolet light;

a motor for rotating said drum about an axis of rotation; and a frame for locating, during operation, all of said drum between the blacklight source and the projection surface;

wherein said drum includes a first pair of areas that are separate from one another and, during operation, block a portion of the beam of ultraviolet light produced by the blacklight source from reaching the projection surface;

wherein said drum includes a second pair of areas that are separated from one another by said first pair of areas and permit, during operation, a portion of the beam of ultraviolet light produced by the blacklight source to enter said drum through one of said second pair of areas, traverse said drum, and exit said drum through the other of said second pair of areas; and a projection surface for receiving the modified beam of ultraviolet light and, in response thereto, producing visible light.

2. A blacklight fixture, as claimed in claim 1, wherein:

said drum defines an enclosed space.

3. A blacklight fixture, as claimed in claim 2, further comprising:

a prismatic optical element located within said enclosed space.

4. A blacklight fixture, as claimed in claim 1, wherein:

said frame includes a mount for engaging a mating surface associated with the blacklight source such that, during operation, said axis of rotation of said drum is substantially perpendicular to the beam of ultraviolet light being projected by the blacklight source.

5. A blacklight fixture, as claimed in claim 1, wherein:

one of said second pair of areas has a wavy pattern.

6. A blacklight fixture, as claimed in claim 1, wherein:

said frame includes a mount for slidably interfacing with a mating surface associated with the blacklight source.

7. A blacklight fixture, as claimed in claim 1, wherein:

said drum has a diameter;

wherein said diameter of said drum is greater than the larger of the horizontal and vertical dimensions of a surface of the blacklight source through which the ultraviolet light produced by the blacklight source is projected during operation.

8. A blacklight fixture, as claimed in claim 1, wherein:

said frame includes a shroud that, during operation, extends between said drum and the blacklight source.

9. A blacklight fixture, as claimed in claim 1, wherein:

said frame includes a shroud that covers about half of said drum.

10. A blacklight special effects system comprising:

a blacklight source for producing a beam of ultraviolet light;

a blacklight fixture comprising:

a closed loop surface for receiving, during operation, the beam of ultraviolet light produced by the blacklight source and interacting with the beam of ultraviolet light to produce a modified beam of ultraviolet light;

a motor for moving said closed loop surface; and a frame for positioning, during operation, all of said closed loop surface between the blacklight source and the projection surface;

wherein said closed loop surface includes a first pair of areas that are separate from one another and, during operation, block a portion of the beam of ultraviolet light produced by the blacklight source from reaching the projection surface;

wherein said closed loop surface includes a second pair of areas that are separated from one another by said first pair of areas and permit, during operation, a portion of the beam of ultraviolet light produced by the blacklight source to enter said closed loop surface through one of said second pair of areas, traverse said closed loop surface, and exit said closed loop surface through the other of said second pair of areas; and a projection surface for receiving the modified beam of ultraviolet light and, in response thereto, producing visible light.

11. A blacklight fixture, as claimed in claim 10 wherein:

said closed loop surface defines an enclosed space.

12. A blacklight fixture, as claimed in claim 11, further comprising:

a prismatic optical element located within said enclosed space.

13. A blacklight fixture, as claimed in claim 10, wherein:

said closed loop surface is a cylinder.

14. A blacklight fixture, as claimed in claim 10, wherein:

said frame includes a shroud that, during operation, extends between said closed loop surface and the blacklight source.

15. A blacklight fixture, as claimed in claim 10, wherein:

one of said second pair of areas has a wavy pattern.

16. A blacklight fixture, as claimed in claim 10 wherein:

said frame includes a mount for engaging a mating surface associated with the blacklight source such that, during operation, an axis about which said closed loop surface rotates is substantially perpendicular to the beam of ultraviolet light being projected by the blacklight source.

17. A blacklight fixture, as claimed in claim 10, wherein:

said frame includes a mount for slidably interfacing with a mating surface associated with the blacklight source.

18. A blacklight fixture, as claimed in claim 10, wherein:

said frame includes a shroud that covers about half of said closed loop surface.

19. A blacklight special effect system comprising:

a blacklight source for producing a beam of ultraviolet light;

a blacklight fixture comprising:

a mask for receiving, during operation, the ultraviolet light produced by the blacklight source and interacting with the ultraviolet light to produce a modified ultraviolet light;

motor means for moving said mask;

a frame for positioning said mask between the blacklight source and the projection surface;

wherein said mask includes a first portion;

wherein said mask includes a second portion that is located between said first portion and the blacklight source;

wherein said motor means is used to move said first and second portions of said mask;

wherein said first and second portions each include a pair of first areas that are separate from one another and, during operation, block a portion of the beam of ultraviolet light produced by the blacklight source from reaching the projection surface;

wherein said first and second portions each include a second area that is located between said first pair of areas;

wherein, during operation, said second areas permit ultraviolet light produced by said blacklight source to pass therebetween and on towards the projection surface; and a projection surface for receiving the modified beam of ultraviolet light and, in response thereto, producing visible light.

20. A blacklight fixture, as claimed in claim 19, wherein:

said motor means causes said first portion and said second portion to move in substantially opposite directions.

21. A blacklight fixture, as claimed in claim 19, wherein:

said motor means causes said first portion and said second portion to move at substantially the same speed.

22. A blacklight fixture, as claimed in claim 19, wherein:

said motor means causes said first portion and said second portion to move in substantially the same direction.

23. A blacklight fixture, as claimed in claim 19, wherein:

said motor means causes said first portion and said second portion to move at different speeds.

24. A blacklight fixture, as claimed in claim 19, wherein:

said mask includes a drum with a diameter;

wherein said diameter of said drum is greater than the larger of the horizontal and vertical dimensions of a surface of the blacklight source through which the ultraviolet light produced by the blacklight source is projected during operation.

25. A blacklight fixture, as claimed in claim 19, wherein:

a prismatic optical element that is located between said first portion and said second portion of said mask.

26. A blacklight fixture, as claimed in claim 19, wherein:

one of said pair of second areas has a wavy pattern.

27. A blacklight fixture, as claimed in claim 19, wherein:

said blacklight source include a first mounting surface;

said frame includes a second mounting surface for slidably engaging said first mounting surface associated with the blacklight source such that said blacklight source and said frame can be slidably engaged and disengaged from one another.

28. A blacklight fixture, as claimed in claim 19, wherein:

said frame includes a shroud that, during operation, extends between said mask and the blacklight source.

29. A blacklight fixture, as claimed in claim 19, wherein:

said frame includes a shroud that covers about half of said mask.

30. A blacklight special effect system comprising:

a blacklight source for producing a beam of ultraviolet light;

a blacklight fixture comprising:

a drum for receiving, during operation, the ultraviolet light produced by the blacklight source and interacting with the ultraviolet light to produce a modified ultraviolet light;

a motor for rotating said drum; and a frame for locating, during operation, all of said drum between the blacklight source and the projection surface;

wherein said drum includes a first pair of areas that are separate from one another and, during operation, block a portion of the beam of ultraviolet light produced by the blacklight source from reaching the projection surface;

wherein said drum includes a second pair of areas that are separated from one another by said first pair of areas, and form a double helix;

wherein said second pair of areas permit, during operation, a portion of the beam of ultraviolet light produced by the blacklight source to enter said drum through one of said second pair of areas, traverse said drum, and exit said drum through the other of said second pair of areas; and a projection surface for receiving the modified beam of ultraviolet light and, in response thereto, producing visible light.

31. A blacklight fixture, as claimed in claim 30, wherein:

said drum has a diameter;

wherein said diameter of said drum is greater than the larger of the horizontal and vertical dimensions of a surface of the blacklight source through which the ultraviolet light produced by the blacklight source is projected during operation.

32. A blacklight fixture, as claimed in claim 30, wherein:

said frame includes a mount for slidably interfacing with a mating surface associated with the blacklight source.

33. A blacklight fixture, as claimed in claim 30, wherein:

said frame includes a shroud that, during operation, extends between said closed loop surface and the blacklight source.

* * * * *